US007186139B2

(12) United States Patent
Chen et al.

(10) Patent No.: US 7,186,139 B2
(45) Date of Patent: Mar. 6, 2007

(54) COAXIAL CONNECTOR WITH ALL METAL SHELL

(75) Inventors: Sung-Wen Chen, Hsin-Tien (TW); Tung-Liang Huang, Hsin-Tien (TW); Huan-Xin Chang, Hsin-Tien (TW)

(73) Assignee: Insert Enterprise Co., Ltd., Taipei Hsien (TW)

( * ) Notice: Subject to any disclaimer, the term of this patent is extended or adjusted under 35 U.S.C. 154(b) by 0 days.

(21) Appl. No.: 11/017,782

(22) Filed: Dec. 22, 2004

(65) Prior Publication Data

US 2006/0134974 A1 Jun. 22, 2006

(51) Int. Cl.
*H01R 13/60* (2006.01)

(52) U.S. Cl. ..... 439/541.5; 439/581

(58) Field of Classification Search ..... 439/579, 439/581, 540.1, 541.5, 63, 79, 541.579
See application file for complete search history.

(56) References Cited

U.S. PATENT DOCUMENTS 4,666,231 A * 5/1987 Sheesley et al. ..... 439/581
5,046,952 A * 9/1991 Cohen et al. ..... 439/63
5,062,811 A * 11/1991 Hackman ..... 439/620
5,088,937 A * 2/1992 Gabany ..... 439/581
5,169,343 A * 12/1992 Andrews ..... 439/608
5,613,880 A * 3/1997 Wang ..... 439/620
5,730,621 A * 3/1998 Wang ..... 439/541.5
5,851,121 A * 12/1998 Thenaisie et al. ..... 439/63
5,989,041 A * 11/1999 Lin ..... 439/79
2003/0236027 A1* 12/2003 Wang ..... 439/541.5

* cited by examiner

*Primary Examiner*—Tulsidas C. Patel
*Assistant Examiner*—Vladimir Imas
(74) *Attorney, Agent, or Firm*—Troxell Law Office, PLLC

(57) ABSTRACT

A coaxial connector with all metal shell comprises a metalwork casing in which at least one positioning hole is disposed; an insulator is accepted in the positioning hole; a terminal is accepted in the insulator; a rear receiving room is disposed at the rear end of the casing; a breach is disposed at one flank side of the rear receiving room; an insulating tenon is combined at the inside of the breach of the rear receiving room; the insulating tenon has a plurality of through holes; at least one ground at the rear end of the casing and a lead wire at the rear end of the terminal is extended out of the casing after being respectively passed the through holes.

13 Claims, 9 Drawing Sheets

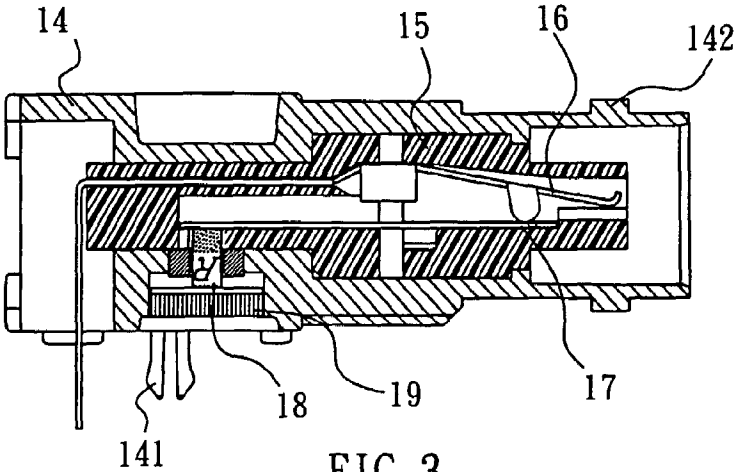
FIG. 3
(PRIOR ART)
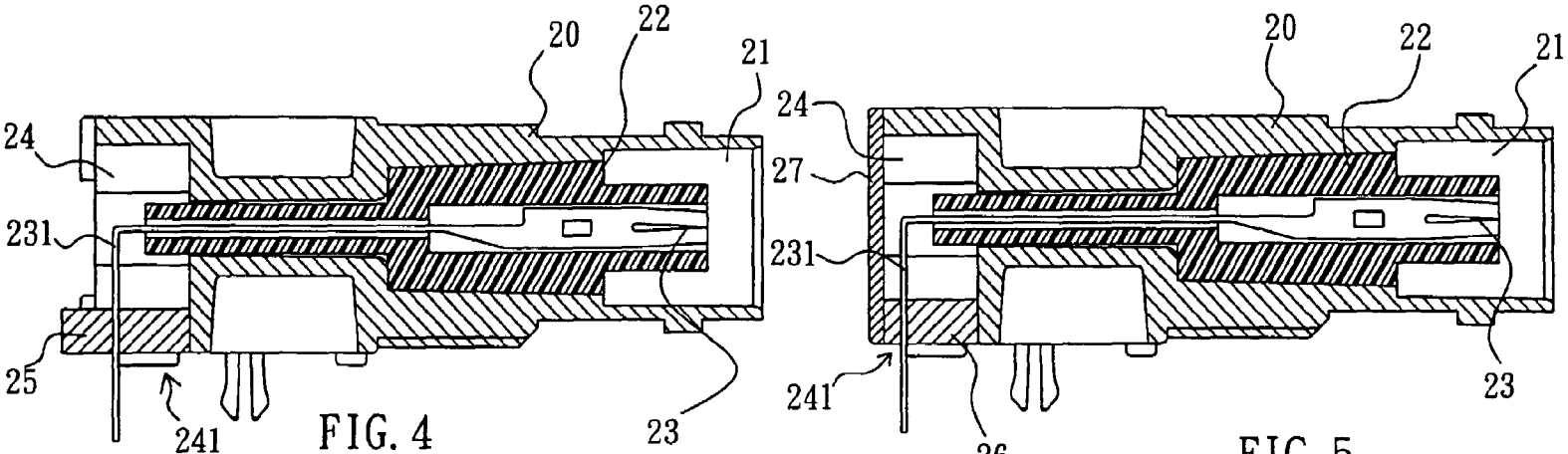
FIG. 5
FIG. 4

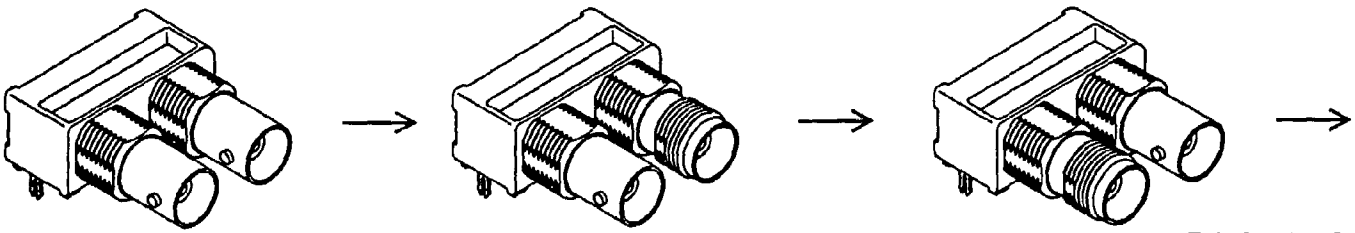
FIG. 21A
FIG. 21B
FIG. 21C
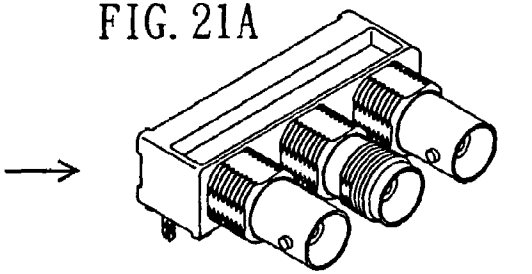
FIG. 21D
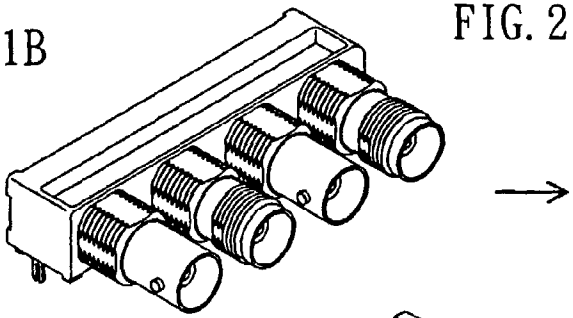
FIG. 21E
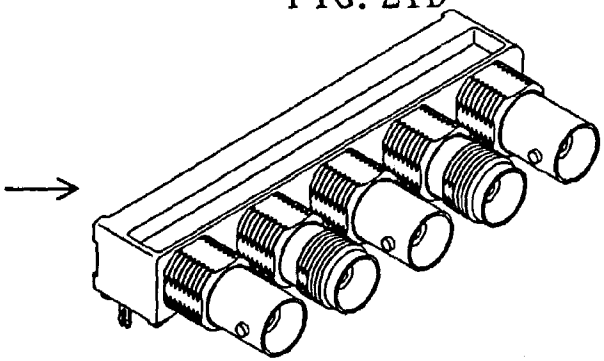
FIG. 21F
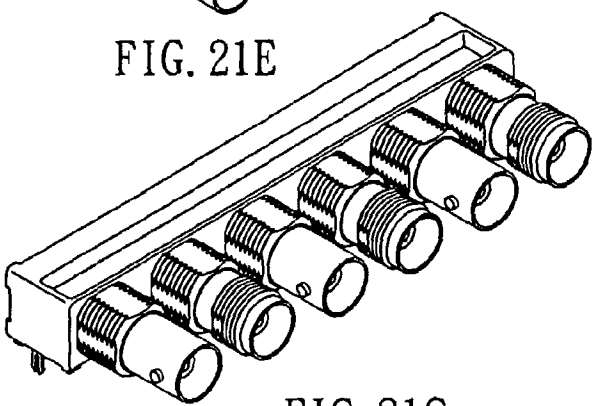
FIG. 21G

COAXIAL CONNECTOR WITH ALL METAL SHELL

BACKGROUND OF THE INVENTION

1. Field of the Invention

The present invention relates to a connector with all metal shell, and more particularly to a coaxial connector with an all metal shell.

2. Description of Related Art

The applicant of the present invention has three patents about electric connectors. One is Taiwan Pat. No. 373,827 entitled "CONNECTOR FOR COAXIAL CABLE". The connector comprises a base seat made from a metal material and a single or a plurality of hollow tubular shell(S) is (are) installed at the front end thereof and a plurality of accepting grooves having the same number as the one of the tubular shells are passed through to the rear ends of the base seats from the front ends of the tubular shells. An insulating tube is located in each accepting groove and a signal terminal is disposed in the insulating tube, the insulating tube, the signal terminal and the hollow tubular shell are coaxial. Please refer to FIG. 1. Outer threads 3 are disposed on the hollow tubular shell 2 at the front end of the base seat 1 are used to engage with the inner threads of the connector being matched with them. This connector with hollow tubular shell 2 on which the outer threads 3 are disposed is generally called TNC connector.

Another is U.S. Pat. No. 6,676,443 entitled "ALL METAL SHELL BNC ELECTRICAL CONNECTOR". As FIG. 2 shows, a connector has a metal shell 10 with at least one positioning hole 11 disposed therein and a BNC terminal 12 is accepted in each positioning hole 11. A metal cover 13 is attached on the bottom of the shell 10 so that the BNC terminals 12 and the lead wires 121 extended from the rear ends of them are accepted in the space defined by the shell 10 and the metal cover 13. Therefore, the consuming rate of the transmission signal power of the BNC connector can be lowered, the interference resulting from the electromagnetic wave can be reduced so as to enhance the quality of the signal transmission of the BNC connector.

Another patent is U.S. Pat. No. 6,390,840 entitled "AUTO TERMINATION PCB MOUNT CONNECTOR", in which insulators 15, a spring plate 16, conductive plate 17, resistor 18 and metal jacket 19 are installed in a casing 14. The metal jacket 19 is pressed tightly from the receiving groove of the casing 14 toward the inner side of the casing 14 to contact and press the resistor 18 against the conductive plate 17. A fixing element 141 is associated at the outside of the casing 14; the connector is caused to be in conjunction with the printed circuit board by inserting the fixing element 141 into a groove in a printed circuit board. The spring plate 16 keeps contacting with the conductive plate 17 in a normal state. The spring plate 16 soon contacts with an inserting end of another connector and is separated from the conductive plate 17 without contacting it if the inserting end of another connector is inserted. When the spring plate 16 and the conductive plate 17 contact with each other, an output signal transmitted to the spring plate 16 can be transmitted back to the ground of the PC plate through the conductive plate 17, the resistor 18, the metal jacket 19, the casing 14 and the fixing element 14 so as to form a close circuit. The circuit in the connector according to the patent can be allowed to have a better filtering function through the resistor so as to reduce the electromagnetic wave interference problem caused from the signal output from the spring plate and lower the loss of the power output. A raised pin 142 disposed at the front end of the casing 14 in the patent is used to combine with a corresponding indented groove in another connector. Such kind of connector is generally called a BNC connector.

SUMMARY OF THE INVENTION

The lead wires of the terminals extended out of the rear ends of the casings of the three kinds of connectors are all not fixed. The portions of the terminals inserted in the printing circuit boards are rather not easily inserted in the corresponding holes in the printing circuit board because the design of the position fixing is absent. Besides, as FIG. 2 shows again, the bottom of the metal shell 10 of a BNC connector is combined with a metal cover 13 at the bottom thereof. Generally, a layer of insulating paint is spread at the inner side face of the metal cover 13 to allow an insulating effect existed between the metal cover 13 and lead wires 121. But, the insulting effect is influenced when the spreading of the insulating paint is uneven. For further improving the insulating effect between the metal cover 13 and the lead wires 121, allowing the portion of the lead wire 121 extended outside of the metal shell 10 to be able to be fixed, and being more easily assembled on a printed circuit board, the present invention is proposed.

The main object of the present invention is to provide a coaxial connector with all metal shell, enabling the portion of an electric lead wire extended out of a shell to be positioned and assembled easily in a printing circuit board.

Another object of the present invention is to provide a coaxial connector with all metal shell, enabling a better insulation effect to be existed between a metal cover and lead wires.

Still another object of the present invention is to provide a coaxial connector with all metal shell, enabling a BNC connector to have an automatic circuit function concurrently.

BRIEF DESCRIPTION OF THE DRAWINGS

The present invention can be more fully understood by reference to the following description and accompanying drawings, in which:

FIG. 3 is a cross sectional view, showing a BNC connector with an automatic circuit function of the prior art.

FIG. 4 is a cross sectional view, showing a coaxial connector of a first preferred embodiment according to the present invention;

FIG. 5 is a cross sectional view, showing a coaxial connector of a second preferred embodiment according to the present invention;

FIGS. 21A and 21G are prospective views, showing respectively a plurality of transversally interlaced BNC and TNC connectors of embodiments according to the present invention.

DETAILED DESCRIPTION OF THE PREFERRED EMBODIMENTS

Figure 2:
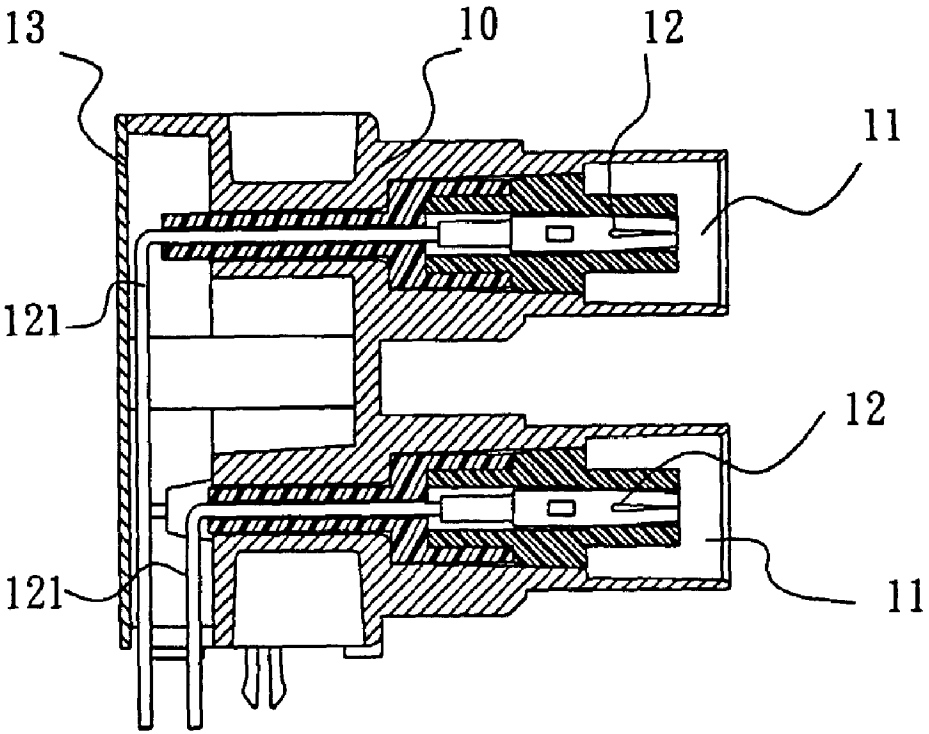
FIG. 2 (PRIOR ART)
FIG. 2 is a cross sectional view, showing a dual type BNC connectors with all metal shell of the prior art.
Figure 1:
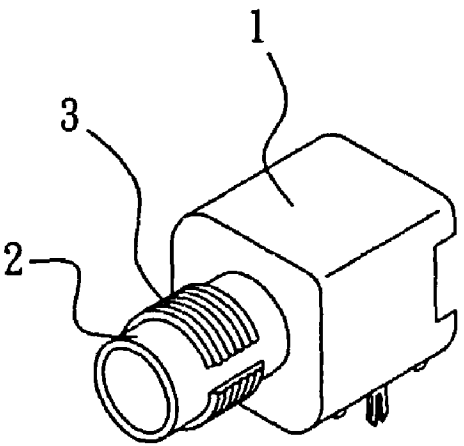
FIG. 1 (PRIOR ART)
FIG. 1 is a prospective view, showing a TNC connector with all metal shell of the prior art.

Please refer to FIG. 4. FIG. 4 shows a coaxial connector of a first preferred embodiment according to the present invention. The coaxial connector comprises a metalwork casing 20 and at least one positioning hole 21 disposed therein. An insulator 22 is accepted in each positioning hole 21. A terminal 23 is accepted in the insulator 22, a rear receiving room 24 is disposed at the rear end of the casing 20. A breach 241 is disposed at one flank side of the rear receiving room 24. An insulating tenon 25 is associated in the breach 241 of the rear receiving room 24. The insulating tenon 25 is protruded out of the rear end of the rear receiving room 24. A lead wire 231 extended to the rear end of the terminal 23 is extended out of the casing 20 after being passed through a through hole of the tenon 25. The lead wire 231 extended out of the casing 20 is positioned by the insulating tenon 231 such that it is easier to be assembled on a printing circuit board.

Please refer to FIG. 5. FIG. 5 shows a coaxial connector of a second preferred embodiment according to the present invention. Although the connector of the second preferred embodiment is approximately same as the one of the first preferred embodiment, but the difference is that an insulating tenon 26 is rather thinner and accepted in the rear receiving room 24 and a metal cover 27 is combined at the bottom of the casing 20 to allow the terminal 23 and the lead wire 231 extended from the rear end thereof to be all accepted in a space surrounded by the casing 20 and the metal cover 27. The embodiment can further lower the loss rate of the power of a transmission signal of the connector and isolate the electromagnetic interference generated from the outer electronic parts so as to enhance the quality of the signal transmission of the connector.

Figure 6:
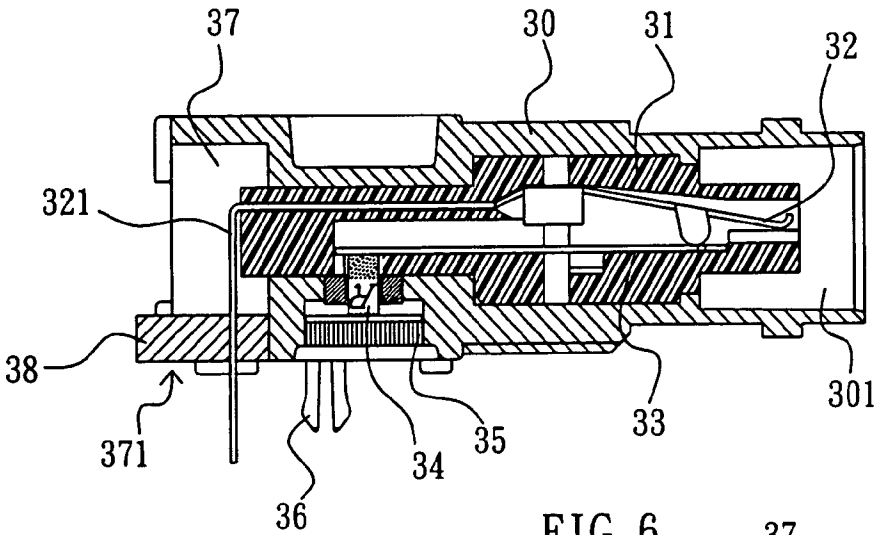
FIG. 6 is a cross sectional view, showing a coaxial connector of a third preferred embodiment according to the present invention.

Please refer to FIG. 6. A coaxial connector with all metal shell of a third preferred embodiment according to the present invention is a connector with an automatic circuit function. The connector comprises a casing 30 with an insulator 31 installed in a positioning hole 301 thereof and a terminal with an automatic circuit function constituted by spring plate 32, conductive plate 33, resistor 34 and metal jacket 35, in which the resistor 34 and the metal jacket 35 are respectively accepted in an corresponding accepting groove of the casing 30, the resistor 34 is pressed tightly by the metal jacket 35 from outside toward inside to prop against the conductive 33. A fixing element 36 is associated with the casing 30 at the outside thereof, the connector can be allowed to combine on a printing circuit board by inserting the fixing element 36 in the groove hole of the printing circuit board. The spring plate 32 is contacted with the conductive plate 33 in a normal state, but if the inserting end of another connector is inserted, the spring plate 32 is soon contacted with the inserting end and separated from and not contacted with the conductive plate 33. When the spring plate 32 is contacted with the conductive plate 33, an output signal transmitted to the spring plate 32 can be transmitted back to the ground of the printing circuit board through the conductive plate 33, the resistor 34, the metal jacket 35, the casing 30 and the fixing element 36 to form a closed circuit. A rear receiving room 37 of the casing 30 has a breach 371; a insulating tenon 38 is associated with the inside of the breach 371, and the lead wire 321 extended out of the casing 321 is caused to position by the through hole of the insulating tenon 38 so as to be easier to be assembled on the printing circuit board. Here, the insulating tenon 38 is projected out to the outside of the rear end of the rear receiving room 37. The circuit of the connector of the embodiment is further allowed to have a better wave filtering effect by means of the resistor so as to lower the interference of the electromagnetic wave caused from the signals output from the spring plate and to reduce the loss of the output power.

Figure 7:
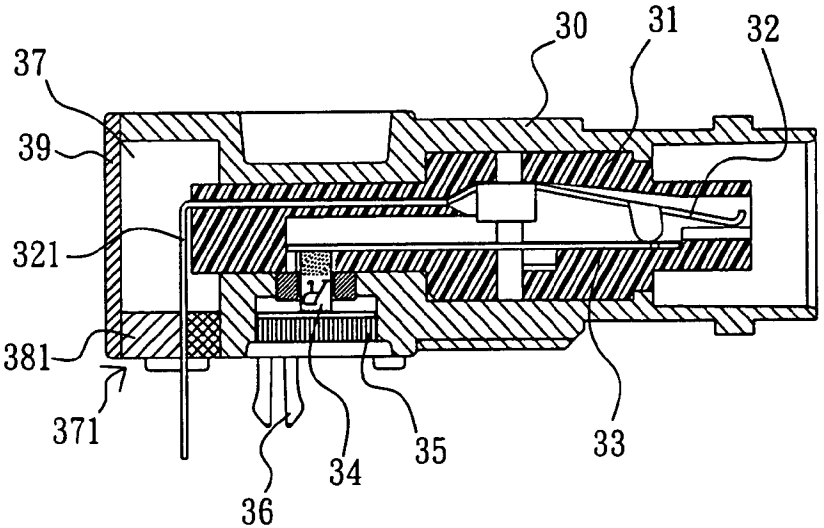
FIG. 7 is a cross sectional view, showing a coaxial connector of a fourth preferred embodiment according to the present invention.

Please refer to FIG. 7. A connector of a fourth preferred embodiment of the present invention is approximately same as the connector of the third preferred embodiment. But, a insulating tenon 381 is rather thinner and is accepted in the rear receiving room 37. Besides, a metal cover 39 is combined with the casing 30 at the bottom thereof to allow the conductive plate 33, the terminal 32 and the lead wire 321 extended from the rear end thereof are all accepted in a space surrounded by the casing 30 and the metal cover 39. The loss rate of a transmission signal power in the connector of the embodiment can be further lowered and the quality of a signal transmission in the connector can be enhanced by isolating the electromagnetic interferences yielded from the outer electronic parts.

Figure 8:
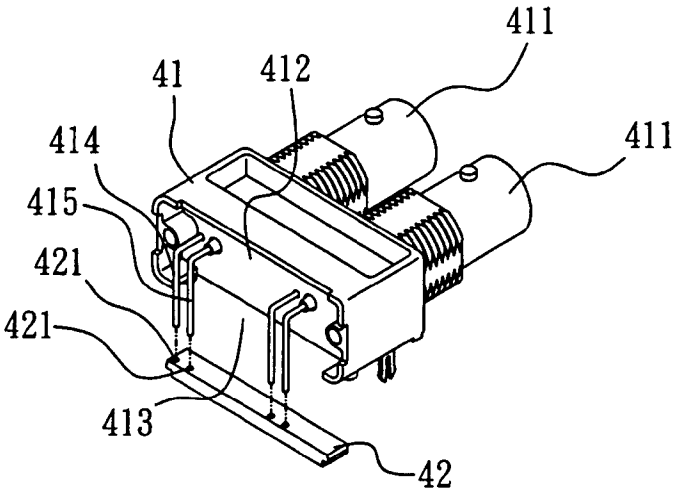
FIG. 8 is a prospective view, showing a coaxial connector of a fifth preferred embodiment according to the present invention.

Please refer to FIG. 8. Two tube bodies 411 disposed at the front end of a casing 41 of a coaxial connector with all metal shell of a fifth preferred embodiment according to the present invention are respectively combined with an insulator and terminal. A breach 413 is disposed in a rear receiving room 412 of a casing 41 and an insulating tenon 42 is combined to the inside of the breach 413. The insulating tenon 42 has a plurality of through holes 421 for allowing a ground 414 of each connector and a lead wire 415 of the terminal to be passed through them so as to cause the grounds 414 and the position of the portion of the lead wires 415 extended out of the casing 41 can be fixed and easier to be assembled on a printing circuit board.

Figure 9:
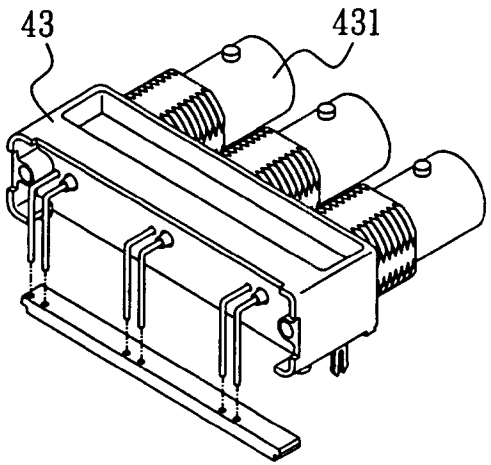
FIG. 9 is a prospective view, showing a coaxial connector of a sixth preferred embodiment according to the present invention.
Figure 10:
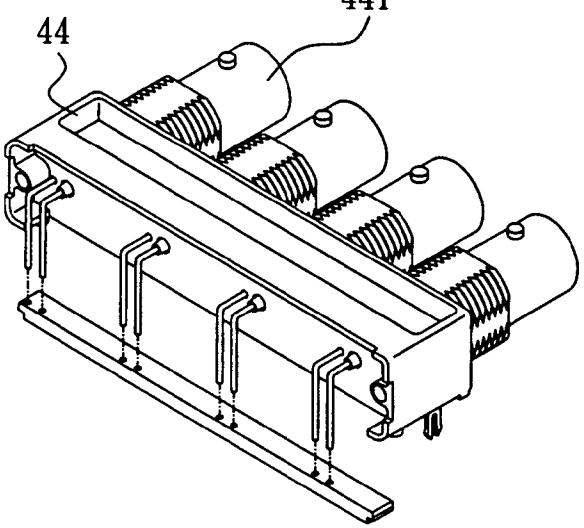
FIG. 10 is a prospective view, showing a coaxial connector of a seventh preferred embodiment according to the present invention.

Please refer to FIGS. 9 and 10. The main difference between a coaxial connector with all metal shell of sixth and seventh preferred embodiments according to the present invention and the one in the fifth preferred embodiment shown in FIG. 8 lies in that casings 43 and 44 of the both respectively have three and four tube bodies 431 and 441 to be respectively combined with insulators or terminals.

Figure 11:
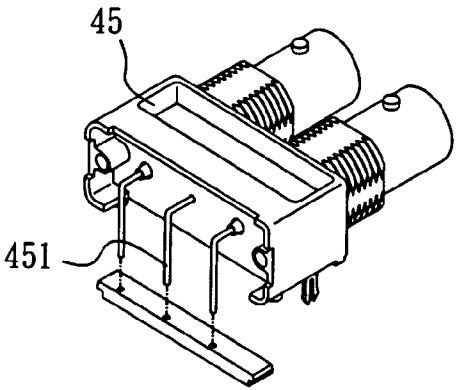
FIG. 11 is a prospective view, showing a coaxial connector of a eighth preferred embodiment according to the present invention.
Figure 12:
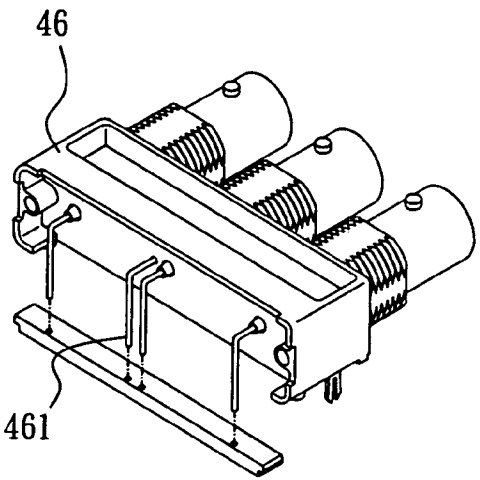
FIG. 12 is a prospective view, showing a coaxial connector of a ninth preferred embodiment according to the present invention.
Figure 13:
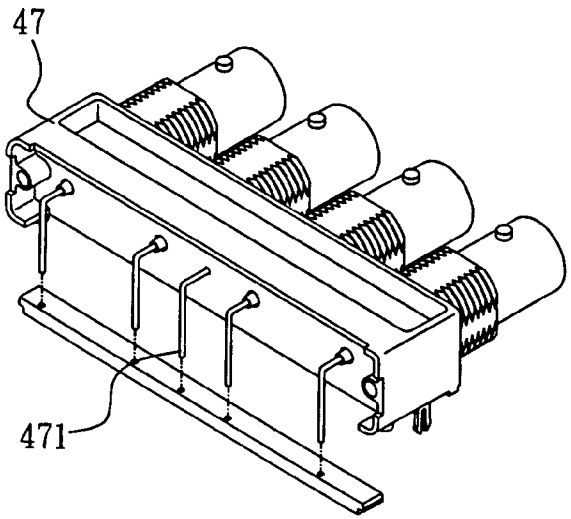
FIG. 13 is a prospective view, showing a coaxial connector of a tenth preferred embodiment according to the present invention.

Please refer to FIGS. 11 to 13. The main difference between a coaxial connector with all metal shell of eighth to tenth preferred embodiments according to the present invention and the ones in the fifth to seventh preferred embodiments lies in that only a ground 451, 461 or 471 is combined with the rear end of each casing 45, 46 or 47 so that the production cost can be saved more.

Figures 14, 15, 16:
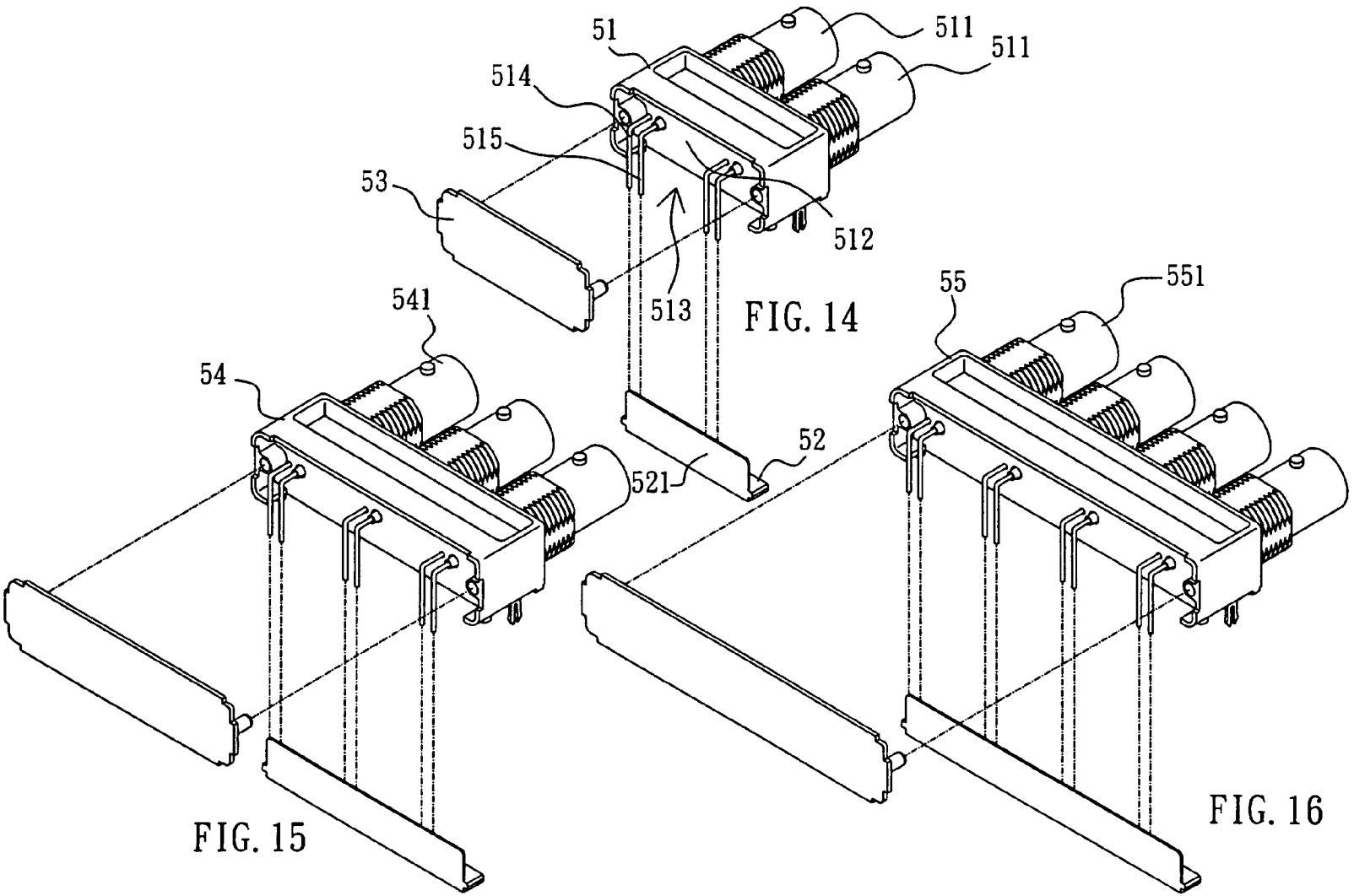
FIGS. 14 to 16 are prospective views, showing respectively coaxial connectors of eleventh to thirteenth preferred embodiments according to the present invention.

Please refer to FIG. 14. Two tube bodies 511 are disposed at the front end of a casing 51 of a coaxial connector with all metal shell of an eleventh preferred embodiment according to the present invention are respectively combined with an insulator and terminal. A breach 513 is disposed in a rear receiving room 512 of the casing 51 and an insulating tenon 52 is combined to the inside of the breach 513, and accepted in the rear receiving room 512. A metal cover 53 is combined at the rear end of the casing 51 to shield the opening of the rear receiving room 512. The insulating tenon 52 has a plurality of through holes for allowing a ground 514 of each connector and a lead wire 515 of the terminal to be passed through to cause the ground 514 and the portion of the lead wire 515 extended out of the casing 51 to be fixed. The insulating tenon 52 has a rear end plate body 521; the rear end plate body 521 is larger than the spreading range of the ground 514 and the lead wire 515 so that the ground 514 and the lead wire 515 can be covered to allow the ground 514 and the lead wire 515 not to contact with the metal cover 53 to attain to the insulation effect. Therefore, a insulating paint needs not to be spread on the metal cover 53 through the design of the rear end plate body 521 of the embodiment isolating each ground, lead wire and metal cover 53, an insulation effect exists between the metal cover and each ground and the lead wire, and an insulation effect can be enhanced.

Please refer to FIGS. 15 and 16. The main difference between a coaxial connector with all metal shell of twelfth and thirteenth preferred embodiments according to the present invention and the one in the eleventh preferred embodiment shown in FIG. 14 lies in that the front ends of the casings 54 and 55 of the both respectively have three and four tube bodies 541 and 551 to combine respectively with insulators and terminals.

Figures 17, 18, 19:
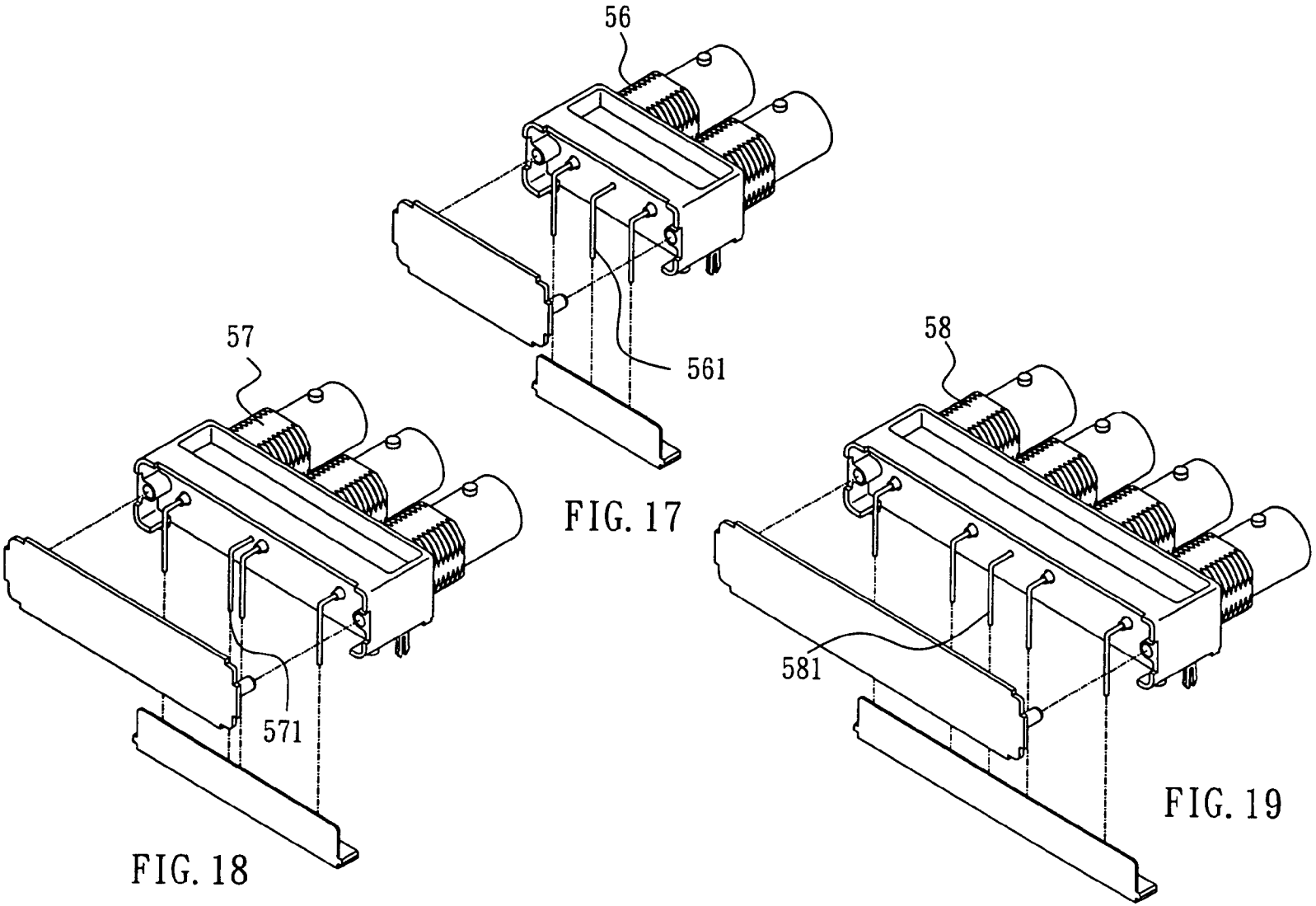
FIGS. 17 to 19 are prospective views, showing respectively coaxial connectors of fourteenth to sixteenth preferred embodiments according to the present invention.

Please refer to FIGS. 17 to 19. The main difference between a coaxial connector with all metal shell of fourteenth to sixteenth preferred embodiments according to the present invention and the one in the eleventh to thirteenth preferred embodiments shown in FIGS. 11 to 13 lies in that only a ground 561, 571 or 581 is combined with the rear end of each casing 56, 57 or 58 such that the production cost can be saved more.

Figures 20A, 20B, 20C, 20D, 20E, 20F, 20G:
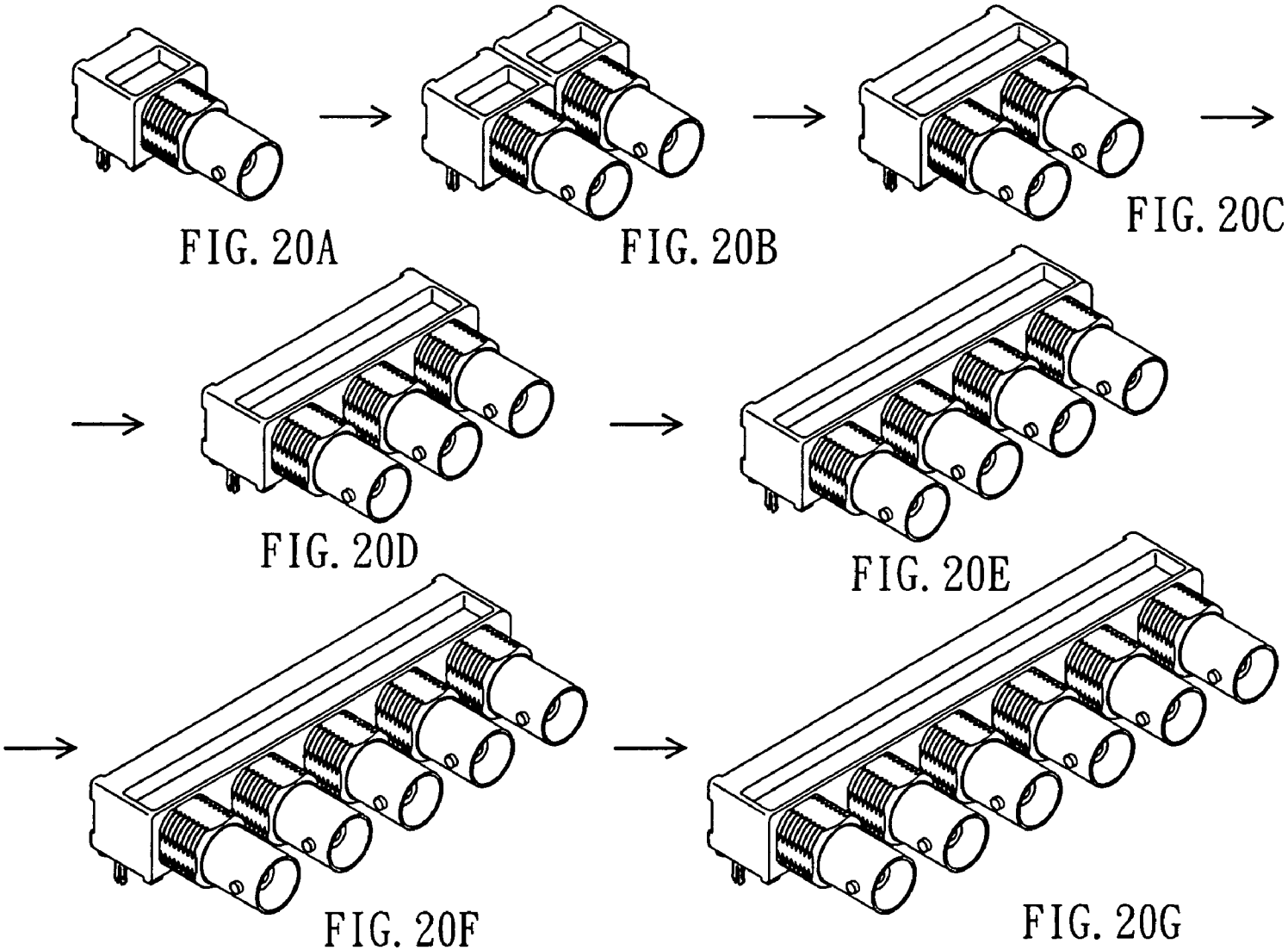
FIGS. 20A to 20G are prospective views, showing respectively a plurality of transversally combined BNC connectors of preferred embodiments according to the present invention.

Please refer to FIGS. 20A to 20G. A coaxial connector with all metal shell according to the present invention can be a single BNC connector, as FIG. 20A shows; or is formed by combining two single BNC connectors together, as FIG. 20B shows; or is formed by allowing the length of a casing to expand transversally and combining two to six BNC connectors respectively into one body transversally, as FIGS. 20C to 20G show. Furthermore, more BNC connectors can be combined transversally.

Please refer to FIGS. 21A to 21G. A coaxial connector with all metal shell according to the present invention can be formed by two BNC connectors, as FIG. 21A shows; or can be formed by a BNC connector and TNC connector, as FIGS. 21B and 21C show; or if the length of a casing needs to be expanded transversally, can be formed by combining three to six interlaced BNC and TNC connectors into to one body, as FIGS. 21D to 21G show; or even formed by combining more transversally connected BNC and TNC connectors.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A coaxial connector with all metal shell, comprising a metalwork casing in which at least one positioning hole is disposed; an insulator being accepted in said positioning hole; a terminal being accepted in said insulator; a rear receiving room being disposed at the rear end of said casing; a breach being disposed at one flank side of said rear receiving room; an insulating tenon being combined at the inside of the said breach of said rear receiving room; said insulating tenon having a plurality of through holes; at least one ground at the rear end of said casing and a lead wire at the rear end of said terminal being extended out of said casing after being respectively passed said through holes whereby, said ground and the portion of said lead wire at the rear end of said terminal passed out of said through holes are allowed to position, wherein insulating tenon is placed in said receiving room; a metal cover is associated with the rear end of said casing to shield an opening of said rear receiving room, wherein said insulating tenon has a rear end plate body, said rear end plate body is covered between said ground and a lead wire at the rear end of said terminal and said metal cover so as to cause said ground and said lead wire at the rear end of said terminal not to contact with said metal cover to attain to an insulation effect.

2. The connector according to claim 1, wherein said terminal is a terminal with an automatic circuit function, comprising a spring plate, conductive plate, resistor and metal jacket; said resistor and said metal jacket are respectively accepted in an accepting groove corresponding to said casing, said resistor is pressed tightly by said metal jacket from outside to inside to prop against said conductive plate, so as to cause said casing, said metal jacket, said resistor and conductive plate to be electrically connected, when an outside BNC male terminal is not inserted in said BNC terminal and is electrically connected with said spring plate, said spring plate is automatically electrically connected to said conductive plate to attain to the automatic circuit function.

3. The connector according to claim 1, wherein said insulating tenon is projected out the rear end of said rear receiving room.

4. The connector according to claim 1, wherein a ground is combined with the rear end of said casing.

5. The connector according to claim 1, wherein said casing is transversally expanded so that said connector has at least two connectors including BNC and TNC connectors connected transversally into one body.

6. The connector according to claim 1, wherein said casing is transversally expanded so that said connector has at least three connectors including BNC and TNC connectors interlaced transversally each other into one body.

7. The connector according to claim 2, wherein said insulating tenon is projected out of the rear end of said rear receiving room.

8. The connector according to claim 2, wherein insulating tenon is placed in said receiving room; a metal cover is associated with the rear end of said casing to shield an opening of said rear receiving room.

9. The connector according to claim 2, wherein a ground is combined with the rear rend of said casing.

10. The connector according to claim 2, wherein said casing is transversally expanded so that said connector has at least two connectors including BNC and TNC connectors connected transversally into one body.

11. The connector according to claim 1, wherein a ground is combined with the rear end of said casing.

12. The connector according to claim 8, wherein said insulating tenon has a rear end plate body, said rear end plate body is covered between said ground and a lead wire at the rear end of said terminal and said metal cover so as to cause said ground and said lead wire at the rear end of said terminal not to contact with said metal cover to attain to an insulation effect.

13. The connector according to claim 1, wherein a ground is combined with the rear end of said casing.

* * * * *